United States Patent [19]

Blann et al.

[11] 4,427,345

[45] Jan. 24, 1984

[54] ARTIFICIAL LIFTING DEVICE AND METHOD

[75] Inventors: Jack R. Blann; Robert C. West, both of Houston; Bolling A. Abercrombie, Montgomery, all of Tex.

[73] Assignee: Hughes Tool Company, Houston, Tex.

[21] Appl. No.: 314,915

[22] Filed: Oct. 26, 1981

[51] Int. Cl.[3] ..... F04F 1/06

[52] U.S. Cl. ..... 417/54; 417/143

[58] Field of Search ..... 417/118, 137, 139, 143, 417/145, 147, 54, 55

[56] References Cited

U.S. PATENT DOCUMENTS

| | | | |
|---|---|---|---|
| 2,142,481 | 1/1939 | Stephens et al. | 417/118 |
| 2,142,484 | 1/1939 | Jennings | 417/147 X |
| 3,797,968 | 3/1974 | Elfarr | 417/145 X |
| 3,873,238 | 3/1975 | Elfarr | 417/118 X |

OTHER PUBLICATIONS

Elfarr Insert Type Chamber Pump—Diagram.

*Primary Examiner*—Richard E. Gluck

*Attorney, Agent, or Firm*—Robert A. Felsman; Charles D. Gunter, Jr.

[57] ABSTRACT

An artificial lifting device has a downhole valve which intermittently directs operating gas to the top of a collection chamber to promote the lifting of oil below the valve upwardly through an annulus defined between a cylindrical housing supporting the valve and an external cylindrical member through which the housing extends. Gas is alternately injected to the top of the chamber through an injection port and vented to the surface through a vent port. An exhaust conduit, separate from the source of pressurized gas running from the surface to the valve, communicates the vent port with the surface when the device is in the vent mode.

14 Claims, 6 Drawing Figures

ARTIFICIAL LIFTING DEVICE AND METHOD

BACKGROUND OF THE INVENTION

This invention relates generally to artificial gas lifting systems used to produce hydrocarbons from well bores and more specifically to a subsurface valve assembly and method for alternately injecting and venting gas for producing heavy oil.

Once a well bore has been drilled between the earth's surface and a producing formation, oil will flow naturally to the surface if the reservoir pressure is great enough to overcome the pull of gravity upon the column of fluid in the well. If the well does not flow naturally, an artificial lifting system of some sort must be employed. Various pumping systems known in the art have been used for flowing hydrocarbons to the surface and include electrical and hydraulic downhole pumps and sucker rod pumps.

In recent years, the so-called "gas lift" systems have gained increasing popularity for producing oil. The gas lift systems can be generally classified as continuous flow and intermittent flow. In the continuous flow system, gas passes continuously into the fluid column through a gas lift valve downhole, thereby aerating the fluid column, making it weigh less. When the static head of the fluid column is reduced enough, pressure from the reservoir overcomes the resistance of the fluid column and the well flows.

In the intermittent system, reservoir fluid is permitted to rise in the tubing for a set interval of time without gas injection. Gas is then injected very rapidly through a gas lift valve. The large influx of gas pushes a portion of the fluid column to the surface. Gas pressure is then decreased to allow fluid to again rise in the tubing.

A variation of the intermittent gas lift system is the chamber lift pump developed by Johnnie Elfarr of Palestine, Tex., and marketed through the Thermo Pump Company of Palestine, Tex. The Elfarr chamber lift pump uses high pressure gas to overcome the weight of the fluid column above the pump in the well bore to pneumatically lift the produced fluid to the surface by a cyclic process of gas injection followed by a hold and then an exhaust sequence. The Elfarr system has several advantages over traditional pump systems including low initial cost, lack of mechanical complexity, and ease of maintenance. Also, typical of gas lift type systems, is the feature that such systems are not adversely affected by deviation of the well bore. Such systems are also less susceptible to problems caused by production of sand, paraffin, salt, or scale.

In spite of these advantages, the Elfarr system is designed so that all of the injection gas is vented back up the injection gas conduit. The use of a single conduit for injection and venting has several drawbacks. These disadvantages include the possibility of back pressure buildup being applied to the formation or the production chamber where oil accumulates, reduced drawdown in the well bore pressure at the formation, longer operating cycle time, and higher gas volume requirements per cycle.

SUMMARY OF THE INVENTION

The artificial lifting device of this invention includes an external cylindrical member adapted to be supported in the well bore and having an injection port and a vent port in the sides thereof. An internal cylindrical housing is mounted within the external cylindrical member. A gas valve means is supported within the housing and connected to a source of pressurized gas at the surface. Passage means within the device allow communication between the gas valve inlet end and the injection port and vent port, respectively. Reciprocating means are provided in the valve means which are reciprocable between an injection position whereby the valve inlet end communicates with the injection port while the vent port is closed, and a vent position whereby the injection port communicates with the vent port while the valve inlet end is closed. An exhaust conduit separate from the valve inlet and communicates the vent port with the surface when the reciprocating means is in the vent position.

In the preferred embodiment, the internal cylindrical housing has vertical side walls and an open top and bottom ends and is mounted within the external cylindrical member adjacent the ports. The gas valve means extends downwardly through the external member and is supported within the internal housing. The valve means sealingly engages the housing top and bottom ends to thereby define an internal chamber between the internal housing vertical walls and the exterior of the gas valve means.

An injection passage and a vent passage extend from the internal chamber through the walls of the housing to the injection port and vent port respectively. A reciprocating piston is slidably received within that portion of the valve means supported within the housing. The piston has sealable end means at both ends thereof.

The piston is reciprocable between an injection position whereby the valve inlet end communicates with the injection port while the vent port is sealed off by the sealable means and a vent position whereby the injection port communicates with the vent port and the valve inlet end is sealed off by the sealable means. An exhaust conduit separate from the valve inlet end communicates the vent port with the surface when the piston is in the vent position. The piston is preferably spring-biased toward the vent position.

In the method of producing hydrocarbons from a well bore, an external cylindrical member is supported in the well bore with the upper end of the member extending to the surface and the lower end of the member being located adjacent the producing formation. The external member has an injection port and a vent port in the sides thereof. An internal cylindrical housing is mounted within the external cylindrical member. A gas valve means is supported in the housing, the gas valve means having an inlet end connected to a source of pressurized gas at the surface.

Passage means are provided between the valve inlet end and the injection port and vent port, respectively. Reciprocating piston means are provided for alternately communicating the valve inlet end and injection port while the vent port is closed and communicating the injection port and vent port while the valve inlet end is closed.

Gas is injected through the valve inlet end, thereby promoting the lifting of hydrocarbons below the valve means upwardly through an annulus defined between the housing and external cylindrical member. An exhaust conduit is provided separate from the valve inlet end for communicating the vent port with the surface when the piston means communicates the injection port and the vent port.

Additional objects, features, and advantages will be apparent in the description which follows.

DETAILED DESCRIPTION OF THE INVENTION

Figure 1:
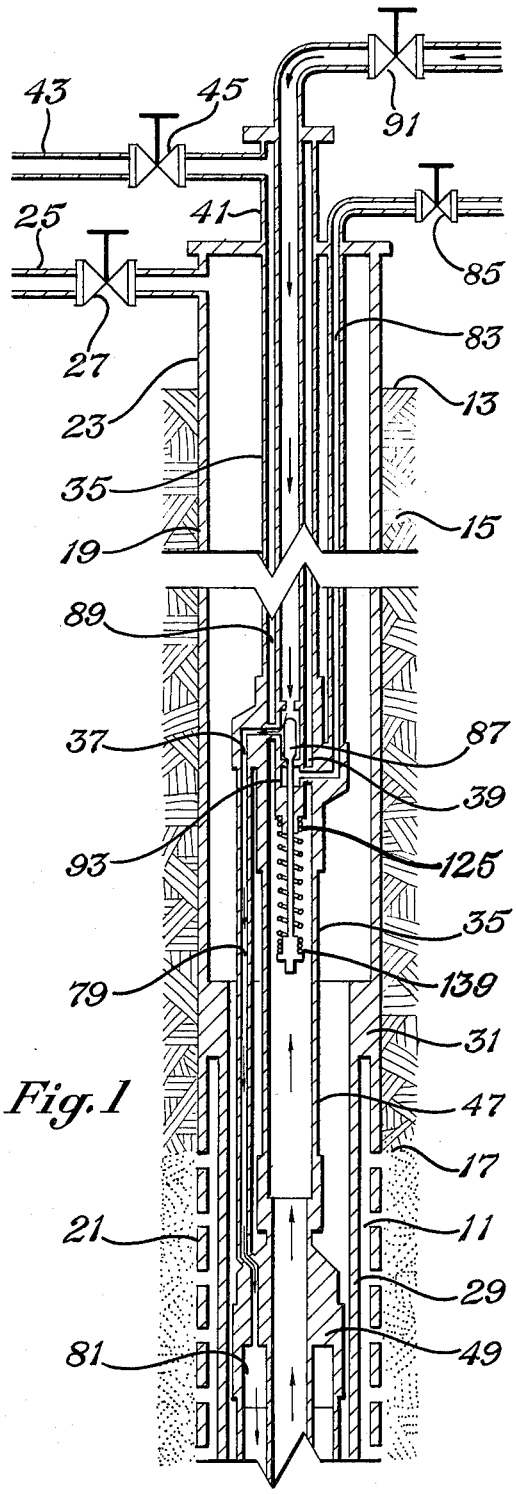
FIG. 1 is a schematic view of the artificial lifting device of the invention in place in a well bore showing the valve means in simplified form in the injection position.

FIG. 1 shows the artificial lifting device of the invention in place in a well bore 11. The well bore 11 is drilled from the surface 13 through the earthern strata 15 to a producing formation 17. Production casing 19 is cemented in place in the well bore and includes a perforated section 21 in the vicinity of the producing zone and an enclosed head 23 which extends above the surface and to which is connected a steam injection pipe 25 provided with a shutoff valve 27. A liner 29 extends from a linear hanger 31 past the producing formation 17 and has an open end 33.

Figure 1A:
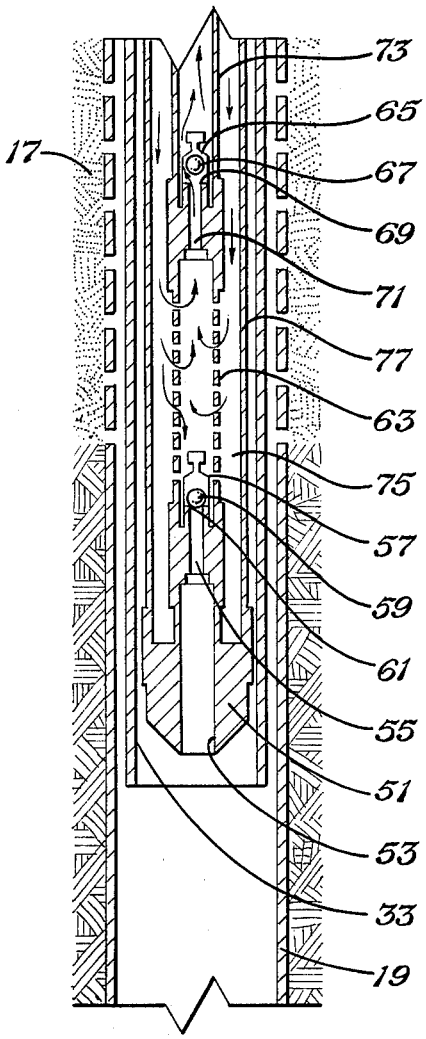
FIG. 1A is a downward continuation of FIG. 1 showing the bottom end of the lifting device of FIG. 1.

Supported within well bore 11 and production casing 19 is an external generally cylindrical member 35 having an injection port 37 and a vent port 39 in the sides thereof. The upper end 41 of member 35 extends above the well surface and has a production conduit 43 provided with a shutoff valve 45. The lower end 47 of member 35 is connected to a lower sub 49 of greater external diameter than lower end 47 and having a shoe 51 having an internal bore 53 therein which communicates with the hydrocarbon fluids which pass through perforated section 21 into production casing 19. Internal bore 53 narrows to form an intake bore 55 which terminates in an intake valve 57. As shown in FIG. 1A, intake valve 57 is provided with a ball 59 which in the position shown sits in a valve seat 61 to thereby restrict the flow of fluids through intake bore 55 in the direction of internal bore 53. Fluid flow in the opposite direction through intake bore 55 acts to unseat ball 59 and allow flow to the interior of the lower sub 49.

Intake valve 57 is connected by means of a perforated nipple 63 to a discharge valve 65 having a ball 67 and ball seat 69. Ball seat 69 is formed in the upper end of a discharge bore 71 similar to bore 55. Fluid flow through discharge valve 65 is communicated to lower end 47 of external member 35 by means of a discharge pipe 73. The annular area between discharge pipe 73 and perforated nipple portion 63 and the cylindrical side walls 77 of lower sub 49 constitutes an oil accumulation chamber 75.

A gas injection line 79 connects injection port 37 of member 35 to the upper end 81 of chamber 75. Vent port 39 in member 35 communicates with the surface by means of a separate exhaust conduit 83. Conduit 83 as shown in FIG. 1 extends above production casing 19 and is provided with a shutoff valve 85. Valve means 87 shown in simplified form in FIG. 1, is supported within member 35 and is connected to the well surface by a tubing string 89 which extends from upper end 41 at the well surface and is provided with a shutoff valve 91.

Figure 2:
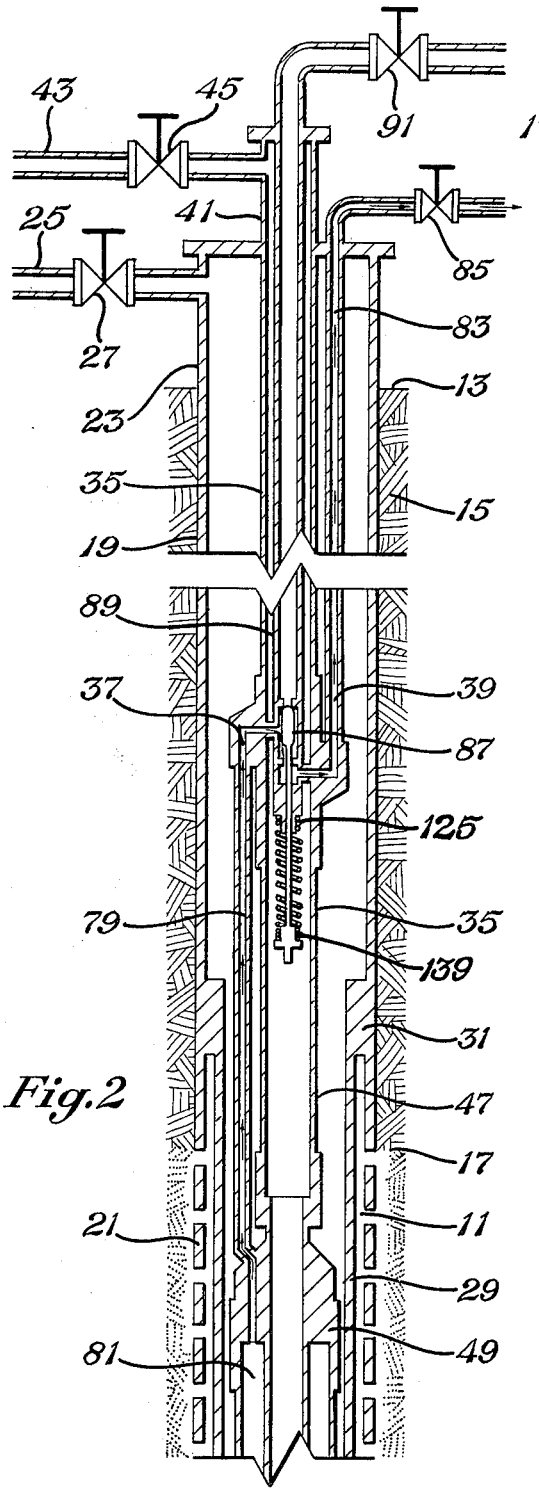
FIG. 2 is a schematic view similar to FIG. 1 but showing the valve means in simplified form in the vent position.
Figure 3:
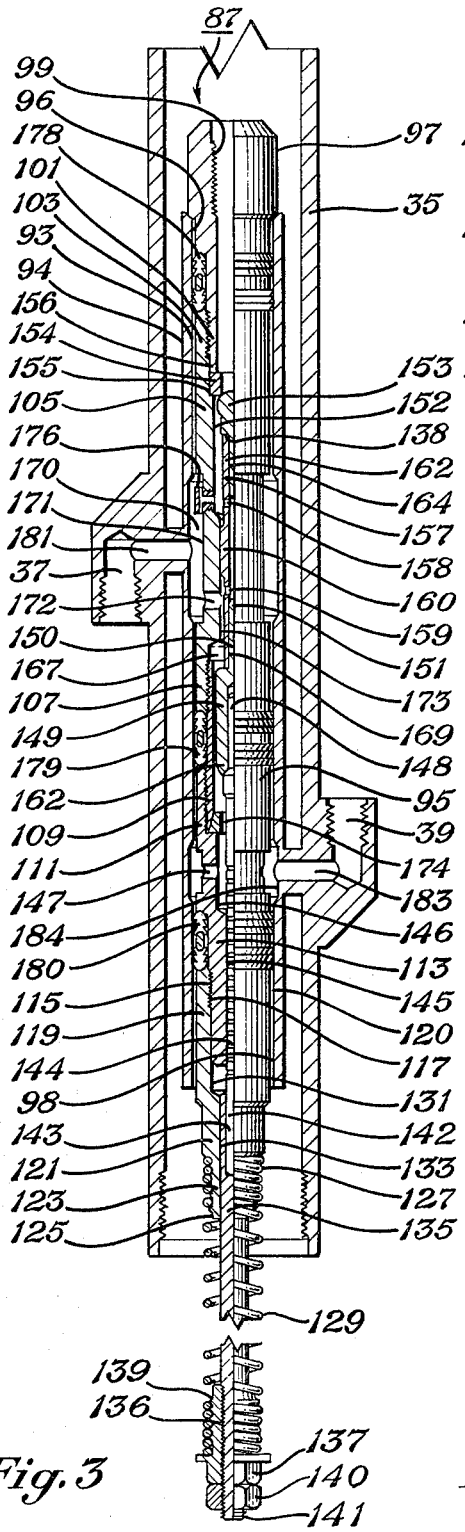
FIG. 3 is a closeup side view of the valve means of FIG. 1 partially in section with the valve means in the vent position.
Figure 4:
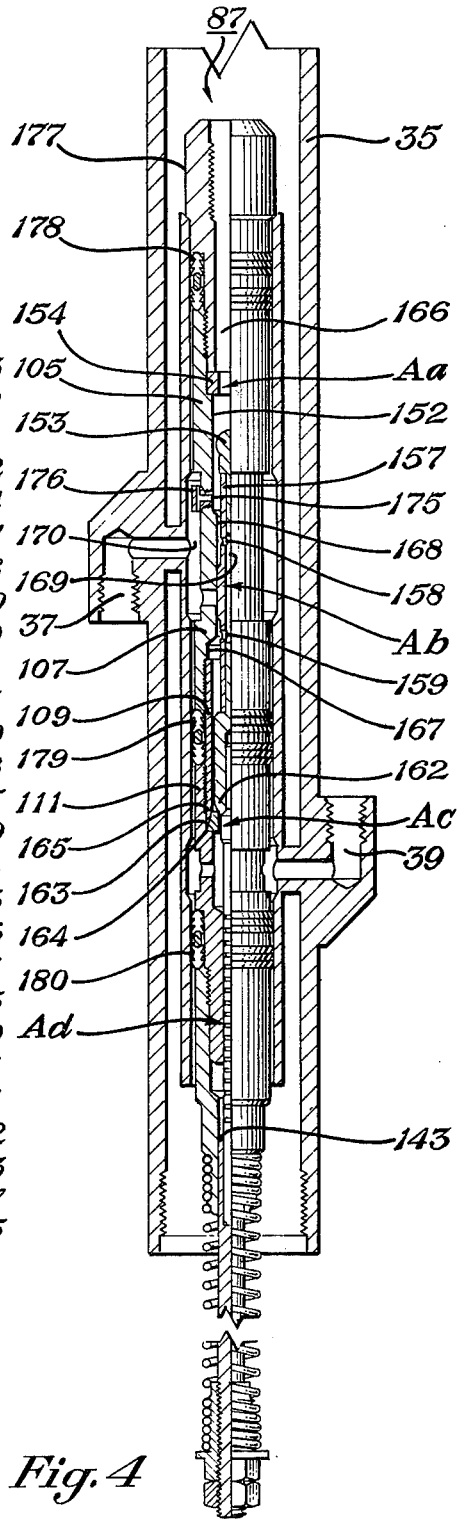
FIG. 4 is similar to FIG. 3 and shows the valve means of FIG. 1 in the injection position.

The valve means 87, which is shown in simplified fashion in FIGS. 1 and 2, is shown in greater detail in FIGS. 3 and 4. As shown in FIG. 3, an internal cylindrical housing 93 is mounted within the external cylindrical member 35. Housing 93 has vertical sidewalls 94 and open top and bottom ends 96, 98 respectively. Gas valve means 87 which extends downwardly through member 35 and is supported within housing 93 includes an upper tubing adapter 97 having a threaded internal surface 99 for connection to the lower end of tubing string 89. Tubing adapter 97 thus comprises an inlet end for connection to the source of pressurized gas. Tubing adapter 97 has a lower externally threaded end 101 which engages the upper internally threaded end 103 of an upper body 105 which has an internally threaded lower end 107. An externally threaded packing mandrel 109 engages the lower end 107 of upper body 105 at one end and threadedly engages the top end 111 of a lower body 113 at the opposite end. Lower body 113 has an externally threaded surface 115 which matingly engages the interior surface 117 of spring adaptor body 119. Spring adaptor body 119 has a cylindrical upper portion 120, a mid-portion 121 of lesser external diameter, and a lower portion 123 of lesser external diameter than mid-portion 121. Lower portion 123 has a grooved exterior surface 125 adapted to engage the upper coils 127 of a coil extension spring 129.

Spring adapter body 119 has an upper internal bore 131 of greater relative diameter and lower internal bore 133 of lesser relative diameter which is adapted to receive one end of a spring tension rod 135. The opposite end of spring tension rod 135 has a threaded surface 136 onto which is threaded a spring hanger 137 having an externally grooved surface 139 adapted to engage the coil end of extension spring 129 opposite upper coils 127. A nut 140 is threaded onto the outer extent 141 of spring tension rod 135. By having one end of extension spring 129 engaged on the exterior surface 125 of adapter 119 and engaged at the opposite end on grooved surface 139 of spring hanger 137, tension rod 135 is spring biased upwardly within lower internal bore 133.

Spring tension rod 135 has a recess 142 at the upper end thereof adapted to receive the lower end of an actuator rod 143. The exterior surface 144 of rod 143 which extends upwardly from recessed bore 142 has formed therein a labrinth seal which is slidingly received within the internal bore 145 of lower body 113. Surface 144 sealingly engages internal bore 145 to prevent the flow of fluids from bore 131 of spring adapter body 119 through bore 145 of lower body 113.

Internal bore 145 of lower body 113 increases in internal diameter to form an exhaust bore 146 which communicates by means of ports 147 and a vent passage 183 with exhaust port 39 in external cylindrical member 35.

The end 148 of rod 143 above surface 144 is received within the lower portion 149 of a travel piston 150. Travel piston 150 has an upper cylindrical portion 151 of lesser external diameter than lower portion 149 which is received within the internal 169 of the lower end of a selector sleeve 157. The generally cylindrical lower end of sleeve 157 increase in external diameter to form an annular ring 160 which slidingly engages the interior sidewalls of upper body 105. The external diameter of selector sleeve 157 decreases above annular ring 160 to form a cylindrical end portion 162 adapted to receive a valve stem 164 having a ball shaped end 153. Ball shaped end 153 protrudes from sleeve 157 with end portion 162 engaging an external shoulder 138 formed at the junction of stem 164 and end 153. Ball shaped end 153, in the position shown in FIG. 3, sealingly engages a ball seat 154 carried between a shoulder 155 in the interior of upper end 103 and the lower extent 156 of upper tubing adapter 97. Selector sleeve 157 also has an opening 158 above and an opening 159 below annular ring 160.

When the valve means is in the injection position as shown in FIG. 4, the lower extent 162 of travel piston 150 sealingly engages a vent seat 163 carried between a shoulder 164 in top end 111 of lower body 113 and the lowermost extent 165 of selector sleeve 109. In this position, ball 153 has moved off seat 154 and the internal bore 166, or inlet end, of the tubing adapter 97 communicates with the internal bore 152 of upper body 105. Bore 152 communicates with the bore 167 of lower end 107 by means of a clearance 168 between selector sleeve 157 and upper body 105, upper opening 158, the internal bore 169 of selector sleeve 157, and lower opening 159. When piston 153 is off seat 154 as shown in FIG. 4, fluid communication also exists between bore 152 and clearance 170 by means of openings 175 in choke 176.

When the valve means is in the vent position as shown in FIG. 3, ball 153 sealingly engages seat 154, closing off inlet end 166. In this position, injection port 37 communicates with vent port 39 by means of injection passage 181, clearance 190 between upper body sidewalls 171 and housing 93, hole 172 in the sidewalls 171 of upper body 105, annular clearance 173 between the interior sidewalls of body 105 and the exterior of selector sleeve 157, bore 167, clearance 174, exhaust bore 146, and vent passage 183.

As shown in FIG. 4, the exterior surface of valve means 87 sealingly engages housing top and bottom ends 96,98 by means of packing 178, 179, 180 to thereby define an internal chamber between the internal housing vertical walls and the exterior of the gas valve means 87. The internal chamber comprises clearance 170, hole 172, upper and lower openings 158, 159, internal bore 169 of selector sleeve 157, bore 167, clearance 174, exhaust bore 146, ports 147, and clearance 184. An injection passage 181 and a vent passage 183 extends from the internal chamber through the walls of the housing 93 to the injection port 37 and vent port 39 respectively.

The actuator rod 143, travel piston 150, and ball 153 comprise reciprocating piston means in the valve means reciprocable between an injection position whereby the valve inlet end 166 communicates with the injection port 37 while the vent port 39 is closed and a vent position whereby the injection port 37 communicates with the vent port 39 while the valve inlet end 166 is closed. Lower extent 162 of travel piston 150, vent seat 173, ball 153 and seat 154 comprise sealable end means at either end of the piston means.

The overall method of flowing hydrocarbons from a well bore to the earth's surface will now be described. Turning to FIG. 1 and 1A, the device is shown in place in a well bore 11 in the injection position. In the typical case, steam would have been injected through pipe 25 and enclosed head 23 at about 550° for one month, after which time steam would be shut off by means of valve 27 and heavy oil would be flowed to the surface 13 using the artificial lifting device of the invention.

In the method of flowing hydrocarbons, gas is injected through tubing string 89 to inlet end 166 of valve means 87 by opening valve 91. Gas pressure acting on ball 153 causes the ball to move off seat 154 allowing gas to pass through choke 176 to injection port 37 and through gas injection line 79 to the upper end 81 of chamber 75. Pressure on the top of chamber 75 forces oil which has collected in chamber 75 through perforated nipple 63 and through discharge bore 71 causing ball 67 to be unseated and allowing fluid to flow up the annular area between external member 35 and housing 93 to the surface and out production conduit 43.

Figure 2A:
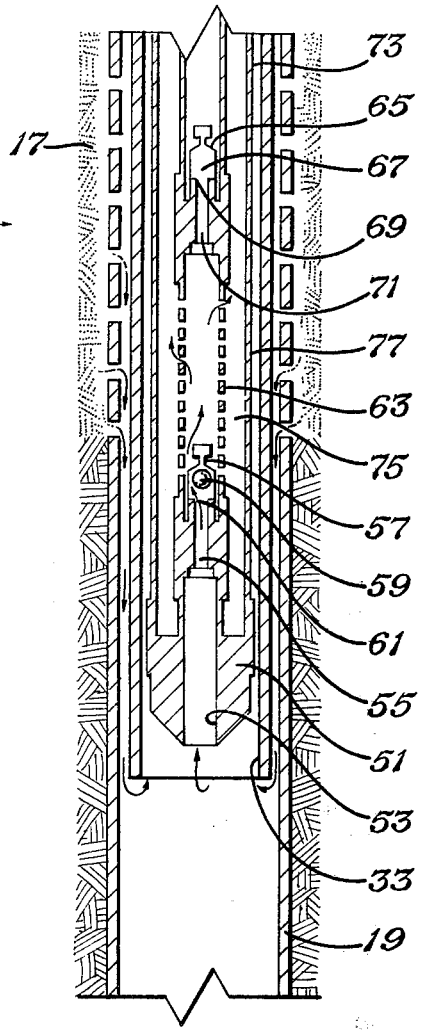
FIG. 2A is a downward continuation of FIG. 2 showing the bottom end of the lifting device of FIG. 2.

Turning now to FIGS. 2 and 2A, the device is shown in the vent position. In this position, injection gas pressure has been reduced by closing valve 91, and ball 153 has moved upward against seat 154 to close off the inlet end 166. Gas in gas line 79 above chamber upper end 81 flows upward through injection port 37, through the valve means 87, and out vent port 39 and exhaust conduit 83 to the surface. At the same time, the reduced pressure on chamber 75 allows oil to flow from the area below shoe 51 upward through bore 53 and intake valve 57 into chamber 75 to refill the chamber.

The operation of valve means 87 is shown in greater detail in FIGS. 3 and 4. FIG. 3, which corresponds to the view shown in FIGS. 2 and 2A, shows the valve means 87 in the vent position as it would be removably supported from a tubing string by means of upper tubing adapter 97. In this way, the valve means would be retrievable from the well bore 11 by retrieving the tubing string. Now assume that valve 91 is opened from the surface and operating gas is injected through the tubing string and upper tubing adapter 97 causing pressure to build up on the upper surface of ball 153. The following relationships will be used in describing the valve operation:

$P_{i/o}$ = Injection gas pressure at the valve means on opening $P_{i/c}$ = Injection gas pressure when the valve means closes—the pressure at which the vent port is open.

($P_{i/o} - P_{i/c}$) Difference between injection gas pressure at opening and closing $P_v$ = Vent pressure $P_c$ = Chamber pressure on top of liquid in chamber 75

$P_f$ = Fluid pressure below the valve (producing liquid pressure)

$A_a$ = Area of the opening in injection seat 154

$A_b$ = Area of the travel piston 150 at the annular ring 160

$A_c$ = Area of the opening in vent seat 163

$A_d$ = Area of the activator rod 143

$K_s$ = Spring constant $L_p$ = Amount of preload on the spring $\Delta L_a$ = Actual stem travel from injection seat to vent seat $\Delta L_o$ = Anticipated stem travel on opening due to pressure and area relationships $\Delta L_c$ = Anticipated stem travel on closing due to pressure and area relationships The initial forces operating on the reciprocating means of valve means 87 are as follows:

| Opening Forces | Closing Forces |
|---|---|
| $P_{i/o}A_a + P_vA_d$ | $P_vA_a + P_f + A_d + K_sL_p$ |

Where $P_v = 0$ or negligible

At the moment of opening of valve means, the opening and closing forces are equal.

As the injection gas pressure increases, ball 153 gradually moves downwardly off seat 154. Enough additional force must now be generated to force the travel piston 150 to travel to vent seat 163 to close off communication between vent port 39, clearance 174, and bore 167. The additional force is supplied by gas flowing through bore 152 and acting on the larger cross sectional area $^{A}b$ of annular ring 160 through bore 152. The forces are now:

| Opening Forces | Closing Forces |
|---|---|
| $P_{i/o}A_b + P_vA_d$ | $P_vA_b + P_c + A_d + K_s(L_p + \Delta L_o)$ |

Where $^{P}v=0$ or negligible

The additional force created by the injection gas pressure operating on the larger area $^{A}b$ overcomes the additional spring load caused by the downward movement of actuator rod 143. Once lower extent 162 of piston 150 sealingly engages vent seat 163, vent port 39 is sealed off and the gas injection pressure operates on the upper end 81 of chamber 75 as previously described by passing through bore 152 and choke 176.

Now assume that the gas injection pressure has equalized within the valve means and injection of gas at the surface is stopped. $^{P}i/o$ now begins to decline until $^{P}i/c$ is reached. The forces acting on valve means 87 are as follows:

| Opening Forces | Closing Forces |
|---|---|
| $P_{i/c}A_c + P_vA_d$ | $P_vA_c + P_fA_d + K_s(L_p + \Delta L_a)$ |

Where $^{P}v=0$ or negligible

Travel piston 150 now starts to move upwardly allowing lower extent 162 to move off seat 163 and establishing fluid communication between vent port 39, port 147, exhaust bore 146, clearance 174, bore 167, annular clearance 173, hole 172, and injection port 37.

As travel piston 150 starts to move upwardly, the vent pressure acts on area $^{A}b$ and, along with the formation fluid pressure acting on the bottom end of the valve means and springload acting on tension rod 135, moves travel piston 150 to the full forward vent position to sealingly engage injection seat 154 and close the gas inlet 166. The forces acting on travel piston 150 are:

| Opening Forces | Closing Forces |
|---|---|
| $P_{i/c}A_b + P_vA_d$ | $P_vA_b + P_fA_d + K_s(L_p + \Delta L_c)$ |

By alternately increasing and decreasing the pressure of the gas in the injection tubing 89, the valve means 87 can be moved between the injection and vent positions to flow oil to the surface.

By providing a surface control valve of the type known in the art and using the fluid pressure of fluid in the production tubing 43 as a reference point, the valve operation can be automatically controlled by controlling the amount of gas injected through an orifice at the surface.

An invention has been provided with significant advantages. The present device has a separate exhaust conduit which is connected to the surface and operates at or near atmospheric pressure at all times. The separate exhaust conduit assures that no back pressure is applied to the formation or the chamber where the oil accumulates. The result is a greater drawdown in well bore pressure at the formation, thereby allowing higher production rates from the well. Gas is vented only from the lower chamber 81 and gas line 79 during each cycle, thereby maintaining full gas system pressure in the tubing string to the top of the injection seat 154 and hence the top of chamber 75 at all times. This feature greatly increases the frequency of cycles that are possible with the artificial lifting device and also reduces the amount of gas required per cycle. This results in reduced compressor requirements and longer service life of the equipment.

While the invention has been shown in only one of its forms, it should be apparent to those skilled in the art that it is not thus limited but is susceptible to various changes and modifications without departing from the spirit thereof.

We claim:

1. An artificial lifting device for flowing hydrocarbons from a well bore to the earth's surface comprising:

an external cylindrical member adapted to be supported in said well bore from the surface, said member having an injection port and a vent port in the sides thereof;

an internal cylindrical housing mounted within said external cylindrical member to provide an annular area between said external cylindrical member and said housing;

gas valve means supported within said housing and connected by a tubing string running to the surface with a source of pressurized gas, said gas valve means having an inlet end through which pressurized gas is communicated as said gas is supplied through said tubing string;

passage means within the device communicating said gas valve inlet end with said injection port and vent port respectively;

reciprocating means in said valve means reciprocable between an injection position, whereby said valve inlet end communicates with said injection port when pressurized gas is supplied through said tubing string from the surface while said vent port is closed, and a vent position whereby said injection port communicates with said vent port while said gas valve inlet end is closed;

an exhaust conduit separate from said gas valve inlet end communicating said vent port with the surface when said reciprocating means is in said vent position; and a lower sub connected to said cylindrical member having an internal bore which communicates hydrocarbons from the well to said annular area between said external cylindrical member and said housing when gas is supplied through said gas valve inlet end to said injection port to promote the lifting of hydrocarbons below the gas valve means upwardly through said annular area and cylindrical member to the well surface.

2. An artificial lifting device for flowing hydrocarbons from a well bore to the earth's surface comprising;

an external cylindrical member adapted to be supported in said well bore from the surface, said member having an injection port and a vent port in the sides thereof;

an internal cylindrical housing having vertical sidewalls and an open top and bottom ends mounted within said external cylindrical member to provide an annular area between said external cylindrical member and said housing;

gas valve means extending downwardly through said external member and supported within said internal housing and connected by a tubing string running to the surface with a source of pressurized gas, said gas valve means sealingly engaging said housing top and bottom ends to thereby define an internal chamber between said internal housing vertical walls and the exterior of said gas valve means, and said gas valve means having an inlet end through which pressurized gas is communicated as said gas is supplied through said tubing string;

passage means within the device communicating said valve inlet end and said chamber with said injection port and said vent port respectively;

reciprocating means in said valve means reciprocable between an injection position, whereby said gas valve inlet end communicates with said injection port when pressurised gas is supplied through said tubing string from the surface while said vent port is closed, and a vent position whereby said injection port communicates with said vent port while said gas valve inlet end is closed;

an exhaust conduit separate from said gas valve inlet end communicating said vent port with the surface when said reciprocating means is in said vent position; and a lower sub connected to said cylindrical member having an internal bore which communicates hydrocarbons from the well to said annular area between said external cylindrical member and said housing when gas is supplied through said gas valve inlet end to said injection port to promote the lifting of hydrocarbons below the gas valve means upwardly through said annular area and cylindrical member to the well surface.

3. An artificial lifting device for flowing hydrocarbons from a well bore to the earth's surface comprising:

an external cylindrical member adapted to be supported in said well bore from the surface, said member having an injection port and a vent port in the sides thereof;

an internal cylindrical housing having vertical sidewalls and an open top and bottom ends mounted within said external cylindrical member adjacent said ports to provide an annular area between said external cylindrical member and said housing;

gas valve means extending downwardly through said external member and supported within said internal housing and connected by a tubing string running to the surface with a source of pressurized gas, said gas valve means sealingly engaging said housing top and bottom ends to thereby define an internal chamber between said internal housing vertical walls and the exterior of said gas valve means, and said gas valve means having an inlet end through which pressurized gas is communicated as said gas is supplied through said tubing string;

an injection passage and a vent passage extending from said internal chamber through the walls of said housing to said injection port and said vent port respectively;

reciprocating means in said gas valve means reciprocal between an injection position, whereby said gas valve inlet end communicates with said injection port while said vent port is closed, and a vent position whereby said injection port communicates with said vent port while said gas valve inlet end is closed;

an exhaust conduit separate from said gas valve inlet end communicating said vent port with the surface when said reciprocating means is in said vent position; and a lower sub connected to said cylindrical member having an internal bore which communicates hydrocarbons from the well to said annular area between said external cylindrical member and said housing when gas is supplied through said gas valve inlet end to said injection port to promote the lifting of hydrocarbons below the gas valve means upwardly through said annular area and cylindrical member to the well surface.

4. An artificial lifting device for flowing hydrocarbons from a well bore to the earth's surface comprising:

an external cylindrical member adapted to be supported in said well bore from the surface, said member having an injection port and a vent port in the sides thereof;

an internal cylindrical housing having vertical sidewalls and an open top and bottom ends mounted within said external cylindrical member adjacent said ports to provide an annular area between said external cylindrical member and said housing;

gas valve means extending downwardly through said external member and supported within said internal housing and connected by a tubing string running to the surface with a source of pressurized gas, said gas valve means sealingly engaging said housing top and bottom ends to thereby define an internal chamber between said internal housing vertical walls and the exterior of said gas valve means, and said gas valve means having an inlet end through which pressurized gas is communicated as said gas is supplied through said tubing string;

an injection passage and a vent passage extending from said internal chamber through the walls of said housing to said injection port and said vent port respectively;

a reciprocating piston slidably received within said gas valve means;

wherein said piston is reciprocable between an injection position, whereby said gas valve inlet end communicates with said injection port while said vent port is sealed off, and a vent position whereby said injection port communicates with said vent port and said gas valve inlet end is sealed off;

an exhaust conduit separate from said gas valve inlet end communicating said vent port with the surface when said piston is in said vent position; and a lower sub connected to said cylindrical member having an internal bore which communicates hydrocarbons from the well to said annular area between said external cylindrical member and said housing when gas is supplied through said gas valve inlet end to said injection port to promote the lifting of hydrocarbons below the gas valve means upwardly through said annular area and cylindrical member to the well surface.

5. An artificial lifting device for flowing hydrocarbons from a well bore to the earth's surface, comprising:

an external cylindrical member adapted to be supported in said well bore from the surface, said member having an injection port and a vent port in the sides thereof;

an internal cylindrical housing having vertical sidewalls and an open top and bottom ends mounted within said external cylindrical member adjacent said ports to provide an annular area between said external cylindrical member and said housing;

gas valve means extending downwardly through said external member and supported within said internal housing and connected by a tubing string running to the surface with a source of pressurized gas, said gas valve means sealingly engaging said housing top and bottom ends to thereby define an internal chamber between said internal housing vertical walls and the exterior of said gas valve means, and said valve means having an inlet end through which pressurized gas is communicated as said gas is supplied through said tubing string;

an injection passage and a vent passage extending from said internal chamber through the walls of said housing to said injection port and said vent port respectively;

a reciprocating piston slidably received within said gas valve means supported within said housing, said piston having sealable end means at both ends thereof;

wherein said piston is reciprocable between an injection position, whereby said gas valve inlet end communicates with said injection port while said vent port is sealed off by said sealable means, and a vent position whereby said injection port communicates with said vent port and said valve inlet end is sealed off by said sealable means;

an exhaust conduit separate from said valve inlet end communicating said vent port with the surface when said piston is in said vent position; and a lower sub connected to said cylindrical member having an internal bore which communicates hydrocarbons from the well to said annular area between said external cylindrical member and said housing when gas is supplied through said gas valve inlet end to said injection port to promote the lifting of hydrocarbons below the gas valve means upwardly through said annular area and cylindrical member to the well surface.

6. The artificial lifting device of claim 5, wherein said gas valve means is removably supported within said internal housing by a tubing string connected to said valve inlet end and is retrievable from the well bore by retrieving said tubing string.

7. The artificial lifting device of claim 6, wherein said tubing string is connected to a source of pressurized gas at the well surface so that injection of gas through said valve inlet end moves said piston to said injection position thereby promoting the lifting of hydrocarbons below the valve means upwardly through an annulus defined between said internal housing and said external member.

8. The artificial lifting device of claim 7, wherein said piston is spring biased toward said vent position.

9. The artificial lifting device of claim 7, wherein said piston sealable end means located nearest said valve inlet end are of lesser relative cross sectional area than said piston sealable end means located furthest from said valve inlet end.

10. The artificial lifting device of claim 9, wherein said valve inlet end communicates with said injection port by means of a choke passage when said piston is in said injection position.

11. A method of flowing hydrocarbons from a well bore comprising the steps of:

supporting an external cylindrical member in said well bore, the upper end of said member extending to the surface and the lower end of said member being located adjacent the producing formation, said member having an injection port and a vent port in the sides thereof;

mounting an internal cylindrical housing within said external cylindrical member;

supporting a gas valve means within said internal cylindrical housing, said gas valve means having an inlet end;

connecting a tubing string to said gas valve inlet end, said tubing string being connected to a source of pressurized gas at the surface;

providing reciprocating means within said gas valve means for alternately communicating said gas valve inlet end and said injection port while said vent port is closed and communicating said injection port and said vent port while said gas valve inlet end is closed;

providing an exhaust conduit separate from said gas valve inlet end for communicating said vent port with the surface when said reciprocating means communicates said injection port and said vent port;

providing a lower sub connected to said cylindrical member having an internal bore which communicates hydrocarbons from the well surface to an annular area defined between said housing and said external cylindrical member when gas is supplied through said gas valve inlet end to said injection port to promote the lifting of hydrocarbons below the gas valve means upwardly through said annular area and cylindrical member to the well surface;

supplying gas pressure through said tubing string to said gas valve inlet end and injection port while said vent port is closed;

reducing said gas pressure at said gas valve inlet end to communicate said injection port and said vent port while said gas valve inlet end is closed;

repeating said steps to flow hydrocarbons upwardly to the well surface.

12. A method of flowing hydrocarbons from a well bore, comprising the steps of:

supporting an external cylindrical member in said well bore, the upper end of said member extending to the surface and the lower end of said member being located adjacent the producing formation, said member having an injection port and a vent port in the sides thereof;

mounting an internal cylindrical housing having a top and bottom ends within said external cylindrical member;

supporting a gas valve means within said internal housing, said valve means sealingly engaging said housing top and bottom ends to thereby define an internal chamber between said internal housing and said gas valve means and said gas valve means having an inlet end:

slidably positioning a reciprocating piston within said valve means, said piston having sealable end means at both ends thereof;

providing an exhaust conduit separate from said valve inlet end for communicating said vent port with the surface when said valve means communicates said injection port and said vent port;

providing a lower sub connected to said cylindrical member having an internal bore which communicates hydrocarbons from the well to an annular area defined between said housing and said external cylindrical member when gas is supplied through said gas valve inlet end to said injection port to promote the lifting of hydrocarbons below the gas valve means upwardly through said annular area and cylindrical member to the well surface; and alternately supplying gas through said gas valve inlet end to reciprocate said piston between an injection position, whereby said gas valve inlet end communicates with said injection port while said vent port is sealed off by said sealable means, and a vent position whereby said injection port communicates with said vent port and said gas valve inlet end is sealed off by said sealable means.

13. The method of claim 12, further comprising the steps of removably supporting said gas valve means within said internal housing by a tubing string so that said valve means is retrievable by retrieving said tubing string.

14. The method of claim 13, further comprising the step of spring biasing said slidable piston toward said vent position.

* * * * *